United States Patent [19]

Davis et al.

[11] Patent Number: 4,697,511

[45] Date of Patent: Oct. 6, 1987

[54] COMPOSITE ROLL COVERING FOR EXPRESSING MACHINES

[75] Inventors: Steven S. Davis, Farmington; Max A. Mueller, Centerville; Kenneth F. Janecek, Salt Lake City, all of Utah

[73] Assignee: Envirotech Corporation, Menlo Park, Calif.

[21] Appl. No.: 753,033

[22] Filed: Jul. 8, 1985

Related U.S. Application Data

[60] Continuation-in-part of Ser. No. 653,273, Sep. 24, 1984, abandoned, which is a division of Ser. No. 341,728, Jan. 26, 1982, Pat. No. 4,475,453, which is a continuation-in-part of Ser. No. 234,610, Feb. 17, 1981, abandoned.

[51] Int. Cl.[4] ..... B30B 5/04; B30B 13/00

[52] U.S. Cl. ..... 100/37; 100/118; 100/121; 100/153; 210/400; 210/783

[58] Field of Search ..... 100/35, 37, 118, 119, 100/120, 121, 90, 153, 176, 155; 29/130, 131, 132, 121.1; 162/358, 205, 305, 361; 210/400, 401, 386, 783

[56] References Cited

U.S. PATENT DOCUMENTS

| | | | |
|---|---|---|---|
| 872,489 | 12/1907 | Whitney | 29/130 |
| 3,592,134 | 7/1971 | Patterson, Jr. | 29/130 |
| 3,646,652 | 3/1972 | Heiligenthal et al. | 29/130 |
| 3,711,912 | 1/1973 | Teske et al. . | |
| 4,475,453 | 10/1984 | Davis | 100/121 X |
| 4,559,106 | 12/1985 | Skytta et al. | 100/121 |

FOREIGN PATENT DOCUMENTS

| | | |
|---|---|---|
| 443375 | 12/1973 | Australia . |
| 1180677 | 10/1964 | Fed. Rep. of Germany . |
| 1097294 | 1/1968 | United Kingdom . |

OTHER PUBLICATIONS

European Search Report dated Sep. 22, 1986.

*Primary Examiner*—Peter Feldman

*Attorney, Agent, or Firm*—Trask, Britt & Rossa

[57] ABSTRACT

In a dewatering machine for dewatering wet solids in which an elastomeric covered roll applies pressure upon one or more dewatering valves, the improvement whereby the elastomeric roll covering is a multi-layer covering having a graded hardness across the covering layer. A typical covered roll of such a machine is one in which a soft rubber-like material adheres to the surface of the roll and is covered by a harder outer covering.

13 Claims, 11 Drawing Figures

COMPOSITE ROLL COVERING FOR EXPRESSING MACHINES

RELATED APPLICATIONS

This application is a continuation-in-part of U.S. patent application Ser. No. 653,273, filed Sept. 24, 1984, now abandoned, which in turn was a divisional application of U.S. patent application Ser. No. 341,728, filed Jan. 26, 1982 now U.S. Pat. No. 4,475,453, which in turn was a continuation-in-part of U.S. patent application Ser. No. 234,610, filed Feb. 17, 1981, now abandoned. All the aforesaid applications are commonly assigned and name Steven S. Davis as inventor.

BACKGROUND OF THE INVENTION

1. Field:

This invention relates generally to apparatus which remove liquids from wet solid masses by application of mechanical pressure.

2. State of the Art:

There are at present several methods by which the liquid and solid fractions or phases of a wet mixture can be separated to yield a cake. These include vacuum filtration, pressure filtration, centrifugation and compression in, for example, the so-called belt presses.

Any of these methods will yield a cake that, although appearing dry, may still contain more than fifty percent moisture by weight. In situations in which the cake must be further dewatered, removal of more of the remaining liquid phase is typically carried out by heating, which of course significantly adds to the overall operating expense, especially in view of the current high energy costs. For these reasons, it is apparent an improved apparatus which would mechanically remove sufficient liquid phase from the wet mixture to avoid such additional steps would be desirable, not only from the viewpoint of managing the costs of the liquid-solid separation, but also from the broader perspective of conserving scarce energy resources.

An effective apparatus for deliquefying a mass of wet solid particles is disclosed in U.S. Pat. No. 4,475,453. The satellite rolls and primary roll of the apparatus have a resilient rubber-like covering which extends the nips existing between the satellite rolls and the primary roll.

SUMMARY OF THE INVENTION

The instant invention relates to deliquefying machines, especially dewatering machines which are utilized for dewatering thick slurries, wet filter cake, and the like. The water content of such liquid-solids masses varies considerably; however, such masses frequently are characterized by a water content and type of solids material wherein a substantial quantity of the water may be removed by squeezing the material. Machines especially adapted for deliquefying wet solids by squeezing are characteristically identified as "expressing machines."

The expressor machines of the instant invention are ones which employ an elastically deformable layer of material between a pressure roll and the material to be dewatered, which is commonly deposited between a pair of continuous belts, at least one of which is porous to the liquid medium being removed from the wet solid mass. This elastically deformable layer, within the terms of this invention, is a covering adherent to the surface of a pressure roll, said covering having a graded deformability. Preferably, the covering has a hard surface skin subtended by a softer, more elastically deformable material strongly adherent to the surface of the pressure roll.

Alternatively, a composite layer may be interposed between the pressure roll and the wet solids by a continuous belt which has a hard surface layer adjacent the belts sandwiching the wet solids material therebetween and a softer, more elastically deformable layer between the hard surface layer of the belt and the pressure roll.

The invention particularly relates to expressing machines which have a primary roll about which a pair of belts pass which are contacted by satellite rolls having a composite surface covering of at least two phases or layers wherein the outer layer is a harder; i.e., less deformable, more durable material than the inner layer. The outer layer may be characterized by the following attributes:

1. It is generally hard; i.e., has a low deformability, thereby spreading any force applied to it across a greater area of the inner layer, and also extending the nip, thereby applying a substantially evenly distributed force to a large area of wet solids.

2. It is substantially durable; i.e., resistant to abrasion, corrosion, erosion, etc., thereby protecting the less durable inner layer.

3. It is smooth and non-porous so that it is not squeezed into interstices of the porous belt which would tend to blind the belt and provide a low-friction surface to contact the porous belts between which a wet solid mass is sandwiched.

4. It is tough; i.e., has a high degree of resistance to tear and mechanical fatigue from flexing.

In comparison, the inner ply has the following characteristics:

1. It is more deformable than the outer ply, flexing, compressing and stretching as necessary to accommodate the forces exerted between a primary roll and a satellite roll of an expressing machine, for example, to provide an extended nip.

2. It is generally thicker than the outer layer, and typically is several times thicker.

3. It is strongly adherent to the outer layer and to the subjacent roll surface.

The term "deformability" as used herein is percent deformation of a material under a given load applied over a defined surface area. "Elastic deformability" refers to deformation of a material which elastically recovers to its original thickness. In the instant invention, deformation of an elastically deformable composite covering occurs through pressurized contact between a primary roll and a compositely covered satellite roll. The rebounding or elastic recovery of the composite covering on a satellite roll should occur in less than one revolution of the satellite roll.

Further description of the invention may be facilitated by reference to the attached drawings.

DESCRIPTION OF THE INVENTION

Figure 1:
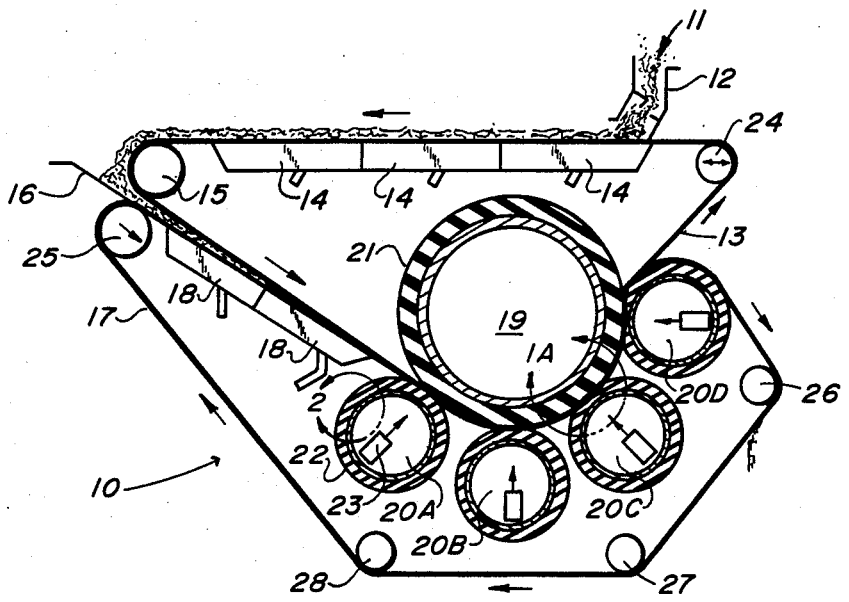
FIG. 1 is an elevational schematic illustration of an expressing apparatus having composite elastically deformable coverings on the pressure rolls.

FIG. 1 depicts an expressing apparatus 10 used for dewatering or deliquefying wet solids. Wet feed stock 11 passes through a chute 12 to be fed upon a belt 13 which is sufficiently porous such that the wet feed stock is dewatered to some extend as it passes over vacuum pans 14. Gravity pans may also be used for collecting water which flows from the wet feed stock by means of gravity without assistance of a vacuum. Belt 13 turns about pulley 15 whereby the feed stock is dumped upon the feed guide 16 which directs the feed stock in between belts 13 and 17. Belt 17 is also a porous belt. As the wet material is compressed into the narrowing space between belts 13 and 17, a vacuum may also be applied by means of vacuum pans 18 whereby water is removed prior to the feed stock entering into the nip between drum 19 and roll 20. Primary roll 19 has a unitary elastically deformable covering 21 on it, while roll 20 has a composite elastically deformable covering 22 which is shown in more detail in FIGS. 1A and 2.

As the wet material enters between belts 13 and 17, the pressure applied by roll 20A squeezes water out of the wet mass. Each of these pressure rolls, identified herein as satellite rolls circumferentially located about primary roll 19, applies pressure to the wet mass by squeezing the porous belts towards one another. Satellite rolls 20A through 20D have hydraulic or pneumatic means 23, for example, hydraulic actuated pistons or "rams" associated with each to exert pressure between the satellite roll and primary roll 19. Each of the satellite rolls may have a different force applied to it to exert more or less pressure between a particular satellite roll and the primary roll.

In expressing machines of the type illustrated in FIG. 1, it is preferred to have a wrap of the porous belts 13 and 17 extend about the primary roll 19 for at least 120° and preferably upwards of about 180°. The number of satellite rolls located about a primary roll may vary considerably, although typically three or more satellite rolls are utilized. Other aspects of such expressing machines, such as varying forces applied to different rolls and increasing deformability of the elastically deformable coverings on successive satellite rolls are more fully discussed in the aforementioned parent applications.

Belts 13 and 17 are continuous belts which are typically driven by primary roll 19, although other pulleys, such as pulley 15, may drive belt 13 with pulley 24 being a take-up or tensioning pulley with respect to belt 17. Pulley 25 may be either a tensioning pulley or a drive pulley with pulley 26 then being a tensioning pulley. Pulleys 27 and 28 are typically idler pulleys and change of direction pulleys or rollers. Because of the width of the porous belts, the pulleys associated with them will generally have a length far greater than their diameter, and, therefore, have a configuration which is a slender right cylinder.

Figure 1A:
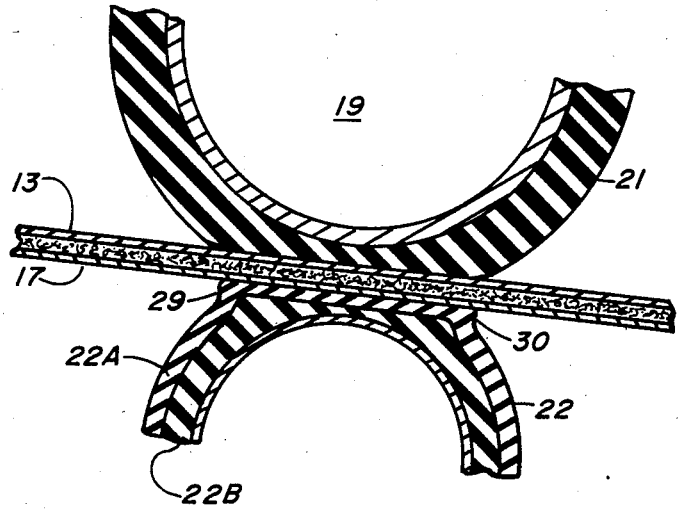
FIG. 1A is a detailed illustration of the interaction of a pressure roll having a composite elastically deformable covering and a primary roll with an elastically deformable covering with a pair of belts sandwiching a layer of solid material between them.
Figure 2:
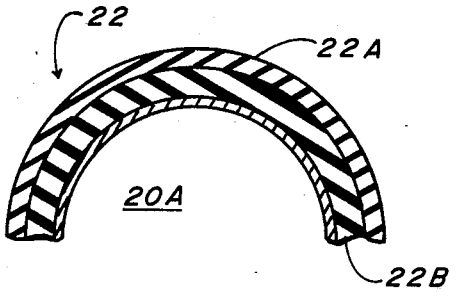
FIG. 2 is a detailed illustration of a pressure roll having a composite elastically deformable covering.

Details of the composite elastically deformable surface upon the satellite rolls are illustrated in FIGS. 1A and 2. FIG. 2 shows satellite roll 20A with a composite elastically deformable covering 22 comprising a surface skin 22A of a hard, durable, elastically deformable material and an inner, softer, elastically deformable ply 22B which is more deformable than the surface skin 22A. Both surface skin 22A and inner ply 22B may be elastomeric materials wherein skin 22A is a harder, less deformable material than ply 22B. The graded deformable covering 22 on the satellite roll in conjunction with the deformable covering 21 on the primary roll, causes the nip existing between the rolls to be extended, thereby exerting a pressure upon the porous belts 13 and 17, and consequently upon the wet solids between the belts, for a longer duration and over a more extended surface area.

Whenever a high degree of pressure is applied to the dual belts, especially between a first satellite roll without a composite cover and the primary roll over a very short distance, that is, a very short nip, the wet material tends not to feed between the satellite roll and the drum. Thus, it is desirable to extend the nip so that the wet material is subjected to a substantially uniform pressure over a greater period of time and over a greater linear belt distance, which is consequently a greater belt area.

This is illustrated in FIG. 1A which shows the deformation of composite covering 22 and the deformation of deformable covering 21 upon the drum.

An extended nip could be obtained, of course, by using primary rolls of extremely large diameter with satellite rolls of equally large diameter. However, because of cost of construction and space requirements, it is desirable to have a primary roll which is generally no greater than about four to five feet (4–5′) in diameter with a typical diameter of about two to four feet (2–4′). The satellite rolls generally have an outer diameter of from about six inches to one foot (6″–1′) with a typical diameter of about eight inches (8″). Thus, the respective elastically deformable coverings upon the primary roll and the satellite rolls can yield an extended nip which would otherwise require a primary roll and satellite rolls of perhaps ten to twenty times the diameter of the drums and rolls presently being utilized.

The composite elastically deformable covering 22 is generally softer; i.e., more deformable overall than the covering 21 on primary roll 19. Such a correspondence between respective deformabilities of covering 22 and covering 21 is shown in FIG. 1A which shows a distinct buckle at points 29 and 30 of FIG. 1A. Good adhesion should exist between the flexible substratum 22B, the surface of satellite roll 20A and surface skin 22A.

Surface skin 22A is generally characterized by a thickness of about 20 milimeters up to about ten milimeters, with a preferred thickness of about one-quarter inch (¼"). The substratum 22B generally has a thickness of about 10 millimeters to about 60 millimeters, with a thickness of about one-half inch (½") up to slightly greater than three inches (3") being effective. Smaller diameter satellite rolls generally need a thicker covering than do larger diameter satellite rolls.

The surface skin or outer stratum 22A of covering 22 should provide wear resistance, and should generally be non-liquid absorbing, chemical- and water-resistant, and non-binding to the porous belt, that is, sufficiently hard that it is not pressed into the pores of the porous belt. Generally, the outer surface skin should have a hardness; i.e., resistance to deformability which is at least about 50% greater than the hardness of the substratum 22B. The surface skin 22A generally has a Shore A hardness of at least 40 and preferably of 50 or more with a Shore A hardness of 60 or more being particularly useful.

The substratum generally has a Shore A hardness less than about 40 and preferably less than about 30, with a Shore A hardness as low as 10 or lower being useful. The outer skin should be tough, abrasion-resistant and sufficiently flexible and fatigue-resistant so that it can buckle as shown in FIG. 1A at points 29 and 30 without failure due to fatigue and be resistant to the abrasion which occurs between the porous belt and the outer surface of the satellite roll.

It should be understood that any composite covering with a tough outer skin which provides overall resiliency; i.e., elastic deformability, may be utilized. For example, while the outer skin is typically a rubber-like material, it may be a plastic material having little resiliency but having good toughness, abrasion resistance and chemical resistance. A good bond, however, must exist between the surface skin and the substratum which is bonded to a satellite roll. Also, the composite elastically deformable surface may be one in which the hardness and the elastic deformability are graded, that is, vary from the surface of the rolls to the outer skin with the hardness increasing and elastic deformability decreasing in the direction of the surface skin.

Figure 3:
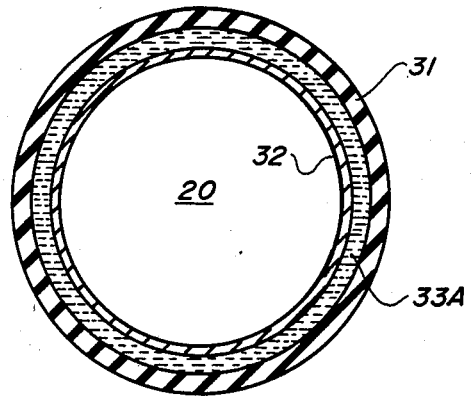
FIG. 3 is an elevational view of a pressure roll having a composite elastically deformable covering in which one layer of the composite is a fluid material.
Figure 4:
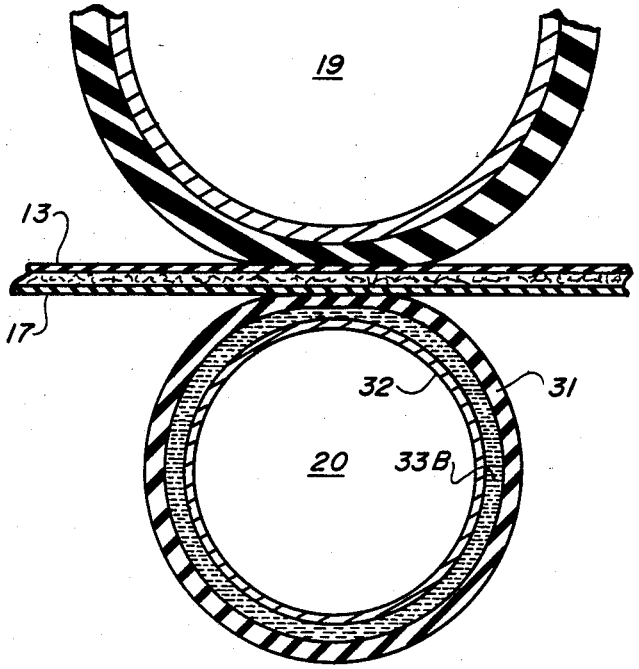
FIG. 4 is a detailed illustration of the nip existing between a roll of the type illustrated in FIG. 3 and a primary roll.

Some other techniques for applying a soft substratum and a hard outer layer or surface are illustrated in FIGS. 3 and 4 where the satellite roll is illustrated with an outer skin 31 which forms an enclosure about the steel surface 32 of the pressure roll to trap a fluid material 33A therebetween. While fluids are not necessarily elastically deformable, fluids contained within an enclosure whose sidewalls have elasticity appear to be elastically deformable. Also, gasses are, of course, compressible.

The composite covering illustrated in FIGS. 3 and 4 is similar to a pneumatic tire about a steel wheel. The annulus between the outer skin 31 and the roll surface 32 is generally rather narrow; i.e., an extended oblong shape in cross-section. The outer skin may have a structure similar to a steel belted tire wherein reinforcement means are embedded therein to provide radial rigidity to the outer skin and to prevent undue "ballooning" of the outer skin on an opposite side of the roll from the nip.

Although pneumatic pressure; i.e., a compressed gas, is useful in the annulus of the device of FIG. 3, the presence of a very viscous liquid material 33B in the annular space provides a very suitable material to combine with a tough, slightly flexible outer skin to form a composite covering. The interaction of the viscous material to form an extended nip is illustrated in FIG. 4.

The viscous material may be a very thick grease, solids-liquid mass, or the like. Preferably, the viscosity or resistance to flow of the viscous material is greater than that of the wet solids mass sandwiched between the dual belts. The resistance to flow of the viscous substratum must be sufficiently great to preclude the outer skin from being collapsed to an extent that it contacts and conforms to the shape of the surface of the satellite roll.

The end walls of the surface skin should be sufficiently stiff so that flow of the viscous material is about the circumference of the steel roll without any substantial lateral flow; i.e., flow parallel to the central axis of the roll.

Figure 5:
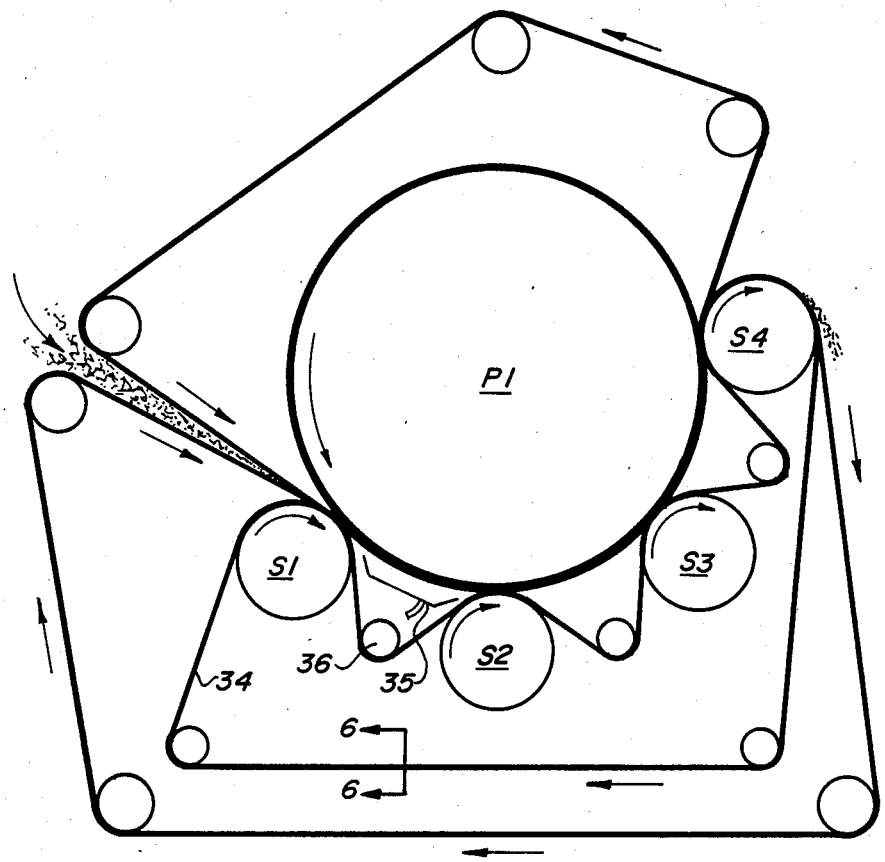
FIG. 5 is an elevational schematic illustration of an expressing apparatus with a composite elastically deformable belt interposed between the dual belts of the apparatus and the satellite pressure rolls.
Figure 6:
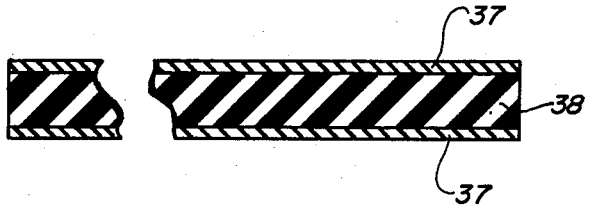
FIG. 6 is a cross-sectional view along section lines 6—6 of FIG. 5 of the composite elastically deformable belt of FIG. 5.

Another arrangment for interposing a graded deformable layer between the satellite roll and the primary drum for the purpose of extending the nip therebetween is illustrated in FIGS. 5 and 6 wherein a composite belt 34 is threaded between the satellite rolls and the primary roll so that the belt 34 wraps about a signficant portion of the circumference of the satellite roll and provides at least contact with the satellite roll through the length of the extended nip. Preferably, the composite elastically deformable belt 34 is spaced from the porous belt in contact with the primary drum in the areas intermediate of adjacent satellite rolls so that the water being extruded or expressed from the wet solids mass may drain through the porous belts and away from the wet solids mass. Collectors 35 may be interposed between adjacent satellite rolls to collect water and drain it away from the composite belt 34 so that it does not drip onto the belt and then caused to be reabsorbed into the wet solids mass by the next contact of the composite belt 34 with the porous dewatering belt.

One technique of spacing the composite elastically deformable belt 34 away from the porous belts intermediate of adjacent satellite drums is by a roller or series of rollers 36 which cause the belt 34 to assume a zig-zag path about the satellite roll and then away from the primary roll and then back in contact with the second primary roll and so forth as illustrated in FIG. 5.

A cross-section of a composite elastically deformable belt 34 is illustrated in FIG. 6. The belt has a hard surface skin 37 on each side of the belt and a softer, more deformable inner core 38. Satellite rolls S1, S2, S3 and S4 may be steel-surfaced satellite rolls or these may have an additional rubber covering if desired. Satellite rolls S1, S2, S3 and S4 may be pressed against the primary drum P1 with varying degrees of force. Also, the primary drum P1 may be steel-surfaced, or it may have a rubber-like covering.

A feature of the apparatus of FIG. 6 is that the composite elastically deformable belt 34 may be more readily replaced than a composite elastically deformable cover adhered to a satellite roll and may also be used to retrofit existing expressing machines so that such machines may be upgraded to incorporate the advantages of the instant invention.

Figure 7:
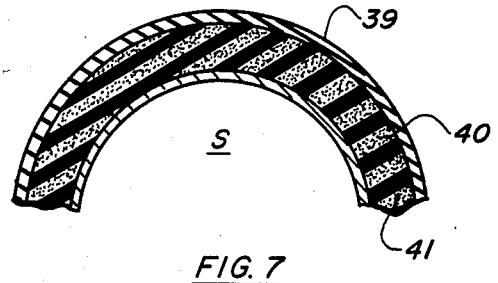
FIG. 7 is a cross-sectional view of a pressure roll having a composite elastically deformable covering in which at least a portion of the resistent material has pores therein.

FIG. 7 illustrates a satellite roll S with a composite elastically deformable covering comprising an outer covering 39 which is a thin, hard, durable, flexible surface skin, and a semi-hard substratum 40 which contains very fine pores 41. Generally, it is preferred that the outer stratum or surface skin be made of a material that is harder and more durable than the substratum, which is generally the preferred construction illustrated in FIG. 7. However, one embodiment of FIG. 7 includes a surface skin and substratum which are of the same rubber-like material wherein the substratum contains very fine pores 41 which contribute more deformability and flexibility to the material, especially compressibility and stretchability, for example, to extend the nip in contact with the primary roll and to permit a buckle to occur as in FIG. 1A. The pores can be distorted to be elongated in any direction to permit compressibility and stretchability.

Figure 8:
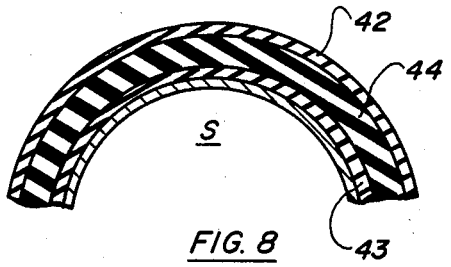
FIG. 8 is a cross-sectional view of a pressure roll having a composite elastically deformable covering containing three layers.

The elastically deformable composite covering illustrated in FIG. 8 is one in which there is a thin, hard, durable surface skin 42 and a similar thin, hard layer 43 of substantially the same material as skin 42 adhered to the satellite roll surface, with an inner, softer, more elastically deformable layer 44 between skin 42 and layer 43. A harder rubber-like layer next to the steel roll S may be more advantageous than contacting the steel roll with the softer, more elastically deformable layer. This embodiment possesses graded deformability wherein the composite covering is highly deformable at the center with decreasing deformability approaching either surface.

Figure 9:
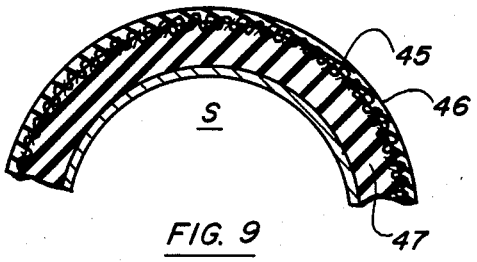
FIGS. 9 and 10 are cross-sectional views of pressure rolls having composite elastically deformable coverings having adhesion-promoting materials interposed at the boundaries between respective layers of the composite covering.

FIG. 9 illustrates an elastically deformable composite covering wherein a fabric 45 is embedded in the respective materials of the composite covering at the boundary layer between the surface skin 46 and the softer substratum 47 to improve adhesion between these two strata of the composite covering.

Figure 10:
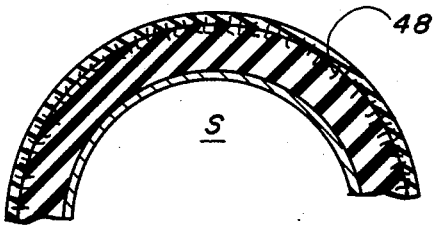

FIG. 10 illustrates another technique for assisting better adhesion between the two strata of the composite covering wherein fibers 48 may be embedded in each strata to intersect the boundary layer between the strata to improve stength and adhesion at such boundary layer between the two strata.

A composite elastically deformable covering which is particularly useful is one comprising an outer ply of a tough, durable elastomer; i.e., a hard, vulcanized natural rubber, and an inner ply of a more elastically deformable, adherent elastomer, which may also be a natural rubber or another polymeric, rubber-like material, including neoprene, urethane, and the like.

Composite elastomerically deformable coverings comprising two plys of different materials, or at least materials with different elastic deformabilities, are preferably adhered to one another and to the satellite roll surface by vulcanizing the whole unit; i.e., roll plus two plys, in one step. Alternatively, adhesives may be used to bond the plys together and to the satellite roll surface.

The composite covering may be formed by applying a ribbon of vulcanizable rubber or rubber-like material to a roll by winding a thin ribbon around the roll until a proper depth is achieved for the inner stratus. A second ribbon of vulcanizable rubber or rubber-like material is then wound around the inner stratum until a desired thickness is obtained for the surface skin. The whole unit is then vulcanized in a conventional manner. The first ribbon of material wound about the roll is one which cures to a more elastically deformable layer than the ribbon secondly applied.

The second layer may be machined to form a regular, smooth, right cylinder configuration.

We claim:

1. In a dewatering system for dewatering wet solids having a pair of dewatering belts, at least one of which is porous, which are squeezed between a large primary drum having a unitary elastically deformable covering and one or more smaller satellite pressure-applying rolls, the improvement comprising satellite rolls with a composite elastically deformable covering layer with an impervious surface skin and having a graded deformability across said layer such that at least the impervious surface skin of said layer in contact with one of said dewatering belts is less deformable than an inner subjacent stratus of the layer in contact with said surface skin, said composite covering being more deformable than the resilient covering on said primary drum, said improvement extending the surface area contact between said drum and said rolls.

2. The elastically deformable layer of claim 1 wherein said composite layer has at least two strata comprising a hard surface skin and a softer subjacent stratum which is more elastically deformable than said surface skin.

3. The elastically deformable layer of claim 1 wherein said layer has a hard, durable, impervious surface skin and a softer, more elastically deformable inner stratum adherent to said surface skin.

4. The elastically deformable layer of claim 3 wherein said softer, more elastically deformable inner stratum is adherent to a subjacent roll surface.

5. The improvement of claim 1 wherein said impervious skin is a rubber-like material having a low coefficient of friction and a Shore A hardness above about 50.

6. The improvement of claim 5 wherein said inner subjacent softer elastically deformable stratum is a rubber-like material having a coefficient of friction significantly lower than said surface skin and an elastic deformability significantly greater than that of said surface skin.

7. The improvement of claim 1 wherein said surface skin has a thickness of about two millimeters (2 mm) to about ten millimeters (10 mm) and said subjacent inner stratum has a thickness of about ten millimeters (10 mm) to about sixty millimeters (60 mm).

8. The improvement of claim 1 wherein said subjacent inner stratum has a thickness at least about twice that of said surface skin.

9. The improvement of claim 1 wherein said outer skin and said subjacent inner stratum are rubber-like materials adherent to one another and to said pressure-applying roll surface by a vulcanization bond.

10. The improvement of claim 1 wherein said surface skin has a machined surface finish.

11. The dewatering system of claim 1 in which at least a pair of satellite rolls are employed.

12. A process for forming the pressure-applying satellite roll of claim 1 comprising:

applying a first enveloping layer of unvulcanized rubber-like material to the surface of said roll;

applying a second enveloping layer of unvulcanized rubber-like material to the surface of said first layer of unvulcanized material, said second layer being of a rubber-like material having a composition such that said material when vulcanized is harder and is less elastically deformable than said first layer in vulcanized form; and subjecting said pressure-applying roll containing said first and second enveloping layers to vulcanizing conditions for a period sufficient to vulcanize said layers.

13. The process of claim 12 wherein said pressure-applying roll with a vulcanized first and second layer is machined until said second layer has a substantially smooth, uniform cylindrical surface.

* * * * *